US005184657A

United States Patent [19]

Hatchman

[11] Patent Number: 5,184,657

[45] Date of Patent: Feb. 9, 1993

[54] MULTI-COMPARTMENTED WALLET AND METHOD OF CONSTRUCTION

[76] Inventor: Robert M. Hatchman, 1507 S. Claremont St., San Mateo, Calif. 94402

[21] Appl. No.: 618,220

[22] Filed: Nov. 26, 1990

[51] Int. Cl.[5] ..... A45C 1/06

[52] U.S. Cl. ..... 150/132; 150/136; 150/140; 150/141; 150/143

[58] Field of Search ..... 150/112, 133, 146, 149, 150/141, 143, 131, 132, 140; 229/72

[56] References Cited

U.S. PATENT DOCUMENTS

| | | | |
|---|---|---|---|
| 364,529 | 6/1887 | Lieker | 150/112 |
| 384,527 | 6/1888 | Jocelyn | 150/112 |
| 647,067 | 4/1900 | Bellairs | 150/140 X |
| 668,524 | 2/1901 | Kendall | 150/112 |
| 939,673 | 11/1909 | Cummings et al. | 150/149 |
| 1,131,135 | 3/1915 | Hudson | 229/72 X |
| 1,404,193 | 1/1922 | Dietsche, Jr. | 229/72 |
| 1,707,025 | 3/1929 | Scheerer | 150/140 |
| 1,937,384 | 11/1933 | Hess | 150/141 X |
| 2,378,020 | 6/1945 | Langworthy | 229/72 X |
| 2,437,587 | 3/1948 | Barton | 150/146 |
| 2,619,144 | 11/1952 | Niswander | 150/146 |
| 2,627,886 | 2/1953 | Barnes | 229/72 X |
| 2,737,992 | 3/1956 | Wright | 150/141 X |
| 3,399,823 | 9/1968 | Johnson | 229/72 |
| 3,643,858 | 2/1972 | Deckys | 229/22 |
| 3,903,945 | 9/1975 | Skeba | 150/133 |
| 4,331,290 | 5/1982 | Benham | 229/72 |

FOREIGN PATENT DOCUMENTS

| | | | |
|---|---|---|---|
| 1114251 | 4/1956 | France | 229/72 |
| 347799 | 7/1937 | Italy | 150/112 |
| 2044129 | 10/1980 | United Kingdom | 229/72 |

*Primary Examiner*—Sue A. Weaver

*Attorney, Agent, or Firm*—James E. Eakin; Janet Kaiser Castaneda

[57] ABSTRACT

A multi-compartmented wallet is formed from a single piece of material in accordance with a predetermined pattern of cuts and fold lines. The generally rectangular material is initially cut leaving tab-like projections extending from both short edges. Slots are cut from a middle region of both short edges and extend inwardly for approximately one third of the length of the rectangle thereby dividing each short edge into two sections. Selected fold lines are pre-creased and each tab and a contiguous triangular portion of material is folded inwardly over the rectangle and the diagonal fold line is secured with adhesive, leaving the tab free. Opposed sections of the short edges of the material are then folded upwardly, and the short edges are pinched in the middle forming two opposed gathers that are perpendicular to the inward fold. The opposed gathers are interlaid to form compartments in the wallet. The completed wallet has fourteen pockets.

In another aspect, a wallet having seven pockets is formed from approximately half of the rectangular piece of material. A section of the material is extended to form a closing flap.

10 Claims, 3 Drawing Sheets

MULTI-COMPARTMENTED WALLET AND METHOD OF CONSTRUCTION

FIELD OF THE INVENTION

The present invention relates to a multi-compartmented wallet and its method of construction. More particularly, the wallet is constructed from a single piece of material by manipulation of the material in accordance with a predetermined pattern of cuts and fold lines. No sewing is required to form the wallet which contains multiple compartments with divider devices therebetween. All compartments are accessible from a single plane.

BACKGROUND OF THE INVENTION

Numerous wallet and billfold designs exist and many of such designs are presently in use. The numerous designs attempt to satisfy consumer demands in the realms of both utilitarian and aesthetic values.

Prior art multi-compartmented wallets typically include a single, a divided single, or a double paper money compartment extending the length of the unfolded, generally rectangular wallet. Compartments for credit cards, identification cards and the like are often placed in front of the paper money compartment and may be designed as slots or pockets for sliding the cards into the wallet. The card compartments may be aligned such that one short side, or one long side, of each card is exposed in a staggered arrangement. There may be multiple locations for card compartments within a single wallet, such as pockets provided on the outside of the wallet and also in the inside of a foldable wallet. A removable transparent insert may also be provided for holding cards and identification materials, such an insert typically having a flap that slips into a slot in the wallet. Coin compartments may or may not be included.

Prior art wallets have been constructed from a multitude of materials and may include linings that are sewn into the wallet. Multiple layers of material may be used, for example to provide pocket compartments, which necessitates further stitching operations to attach the layers together. Stitching may also be required around slots, seams, and cut edges.

One principle drawback of prior art wallets is the limited number of paper money compartments. Another drawback of prior art wallets is the limited number and dimensions of the card compartments. The typical dimensions and number of compartments make it difficult to adapt the prior art wallets to suit the specific purposes of the individual users. The limited number of paper money compartments does not permit effective organization of bills by denomination, or the segregation of bills for particular purposes when desired. A user may not have many cards, but may require additional paper money space. Another user may possess more cards or other documents than can be accommodated by the limited number of card compartments or slots. A user may attempt to conform an inadequate wallet to his/her needs by placing too many cards in a single compartment, or by stuffing the paper money compartment to the point that the wallet is difficult to close, or the bills protrude from the closed wallet.

Another drawback of prior art wallets is limited physical and visual access to the card compartments which are typically accessible at an opening in one short side of the generally rectangular compartments. The problem is aggravated when too many cards are placed within a compartment. Additionally, it may be difficult to remove from or to insert cards or documents into the opening in the short side of the compartment. A user may be forced to remove all of the objects from a particular compartment, to search through the objects to find the desired document/card, and to juggle the wallet throughout the search process. Such a search process may result in the loss of dropped cards, documents, or the wallet itself.

In addition to the access drawbacks described above, access to the card compartments in prior art wallets is not typically obtained from the same edge or plane as the plane of access to the paper money compartment; therefore, upon opening the wallet, the user must move and shift the wallet into a number of positions in order to complete a transaction. Cash may be needed from the paper money compartment, an identification document may be needed from a pocket accessible in another plane, and a credit card may be needed from an additional card compartment accessible in yet another plane. Such maneuvers may place the wallet in positions such that the contents of other slots, pockets or compartments may fall out of the wallet.

Yet another drawback to prior art wallets is cost. Although the use of cheaper materials instead of leather may reduce production costs, sewing, cutting and lining operations are time consuming thereby increasing production costs.

As can be seen from the above summary of the prior art, a need exists for a versatile, easily accessible, easily organized, inexpensively manufactured, and safe multi-compartmented wallet to satisfy the diverse needs of wallet users.

SUMMARY OF THE INVENTION WITH OBJECTS

A general object of the invention is to provide a multi-compartmented wallet and method of manufacture that overcomes the limitations and drawbacks of the prior art.

A specific object of the invention is to provide a multi-compartmented wallet that is simply and inexpensively manufactured.

Another object of the invention is to provide a safer multi-compartmented wallet wherein all of the compartment openings are accessible from the same plane when the wallet is opened for use; and, all of the compartments are inaccessible when the wallet is closed.

Yet another object of the invention is to provide a convenient, versatile, and easily usable wallet with sufficient compartment to permit organization to suit the majority of user needs.

Still another object of the invention is to provide a multi-compartmented wallet with a sufficient number of paper money compartments thereby enabling organization of paper money by denomination, or by purpose, when desired.

Another specific object of the invention is to provide a multi-compartmented wallet that permits the user to view the contents of every compartment of the wallet from a single plane.

Still another object of the invention is to provide a wallet wherein access to the compartments is obtained from the longest dimension of the generally rectangular compartments.

Still one more object is to provide a flatter, foldable wallet that does not fold around the currency that it contains.

In accordance with the present invention, a multi-compartmented folding wallet is formed from a single piece of suitable material, such as leather, by manipulation of the piece of material in accordance with a predetermined pattern of cuts and fold lines. The generally rectangular piece of material is initially cut leaving tab-like projections extending outwardly from both short edges of the rectangle and substantially parallel to the long edges of the rectangle. Slots are cut from a middle region of both short edges of the rectangle and extend inwardly for approximately one third of the length of the rectangle thereby dividing each short edge into two sections. Following completion of all cutting operations, selected fold lines are pre-creased.

To form the wallet, each tab and a contiguous triangular portion of material is folded inwardly over the rectangular. The triangular portion is secured in place using an adhesive, leaving the tab free.

Opposed sections of the two short edges of the material are then folded upwardly towards the center of the material. Each opposed short edge is then pinched in the middle thereby forming two opposed gathers that are perpendicular to the inward fold. The opposed gathers are next interlaid to form pockets of the wallet. The process is next repeated for the remaining two opposed sections of the short edges. The completed wallet has fourteen pockets. Certain pockets contain a tab which serves as a pocket divider. Other pockets have currency folder devices formed by the triangular portions.

In another aspect of the present invention, a wallet having seven pockets is formed from approximately half of the rectangular piece of material. The center section of the material is extended to form a flap to close the non-foldable wallet.

DESCRIPTION OF THE PREFERRED EMBODIMENT

Figure 1:
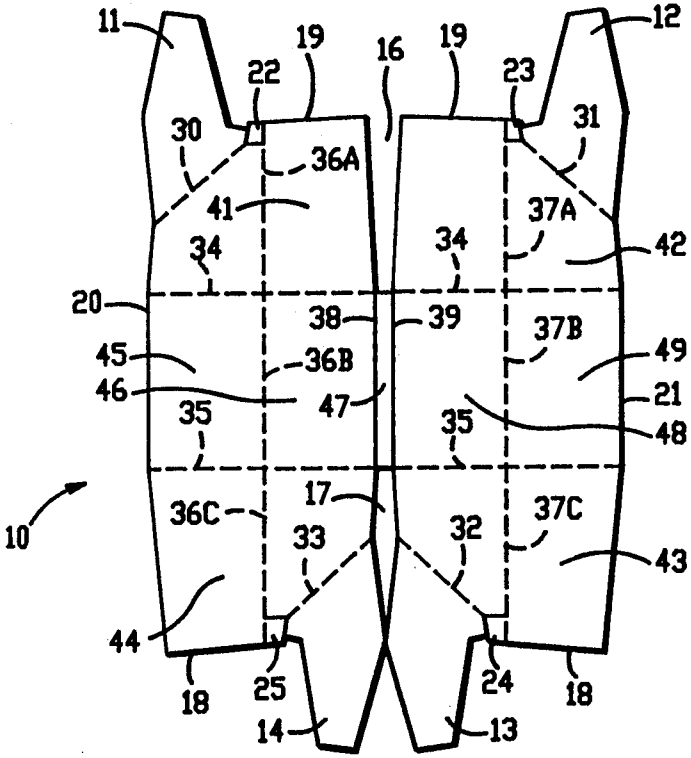
FIG. 1 is a top plan view of an unassembled, pre-cut folding wallet incorporating the principles of the present invention and showing the pre-creasing lines an the fold lines.

Referring to FIG. 1, the inside surface of a single thickness of generally rectangular material 10, preferably leather, is used to form the multi-compartmented folding wallet of the present invention. The wallet may also be constructed from imitation leather, vinyl, nylon plastic or other suitable, flexible materials or combinations of such materials.

The rectangular material 10 includes short edges 18 and 19 and long edges 20 and 21. Tabs 11 and 12 extend outwardly from the ends of short edge 19. Tabs 13 and 14 extend outwardly from the middle region of the short edge 18. Tabs 11, 12, 13 and 14 are perpendicularly aligned with the short edges 19 and 20, and are parallel to the long edges 20 and 21. Slots 16 and 17 are cut into approximately one third of the length of the material 10 from the middle region of both short edges 18 and 19. The slots 16 and 17 bisect each short side 18 and 19 into two substantially equal portions thereby forming four sections 41, 42, 43 and 44. Four substantially square flaps 22, 23, 24 and 25 are cut on three sides thereby remaining attached to material 10. Flaps 22–25 are secured to the inside of the assembled wallet to hold the assembled wallet together.

The dashed lines 30 through 37C represent the fold lines necessary to form the completed, foldable wallet. Lines 30 to 35 are pre-creased to form concave folds in the inner surface of the material and lines 36A, 36C, 37A, and 37C are pre-creased to form convex folds in the inner surface of the material.

Figure 2:
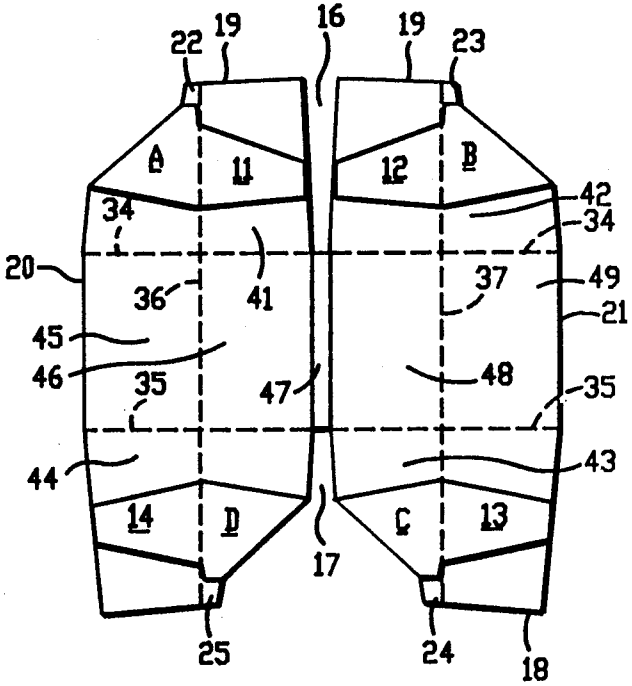
FIG. 2 is a plan view of the wallet of FIG. 1 showing the position of the folded tabs and adjacent triangular material.
Figure 7:
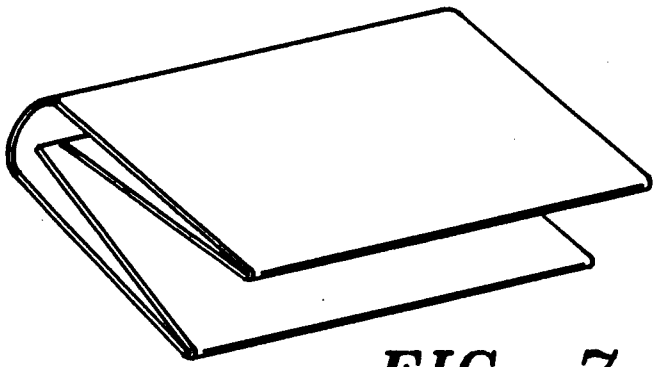
FIG. 7 is a perspective view of the closed wallet of the present invention.

Referring now to FIG. 2, the first step of the folding process is shown with tabs 11 through 14 folded inwardly along diagonal lines 30–33. A suitable adhesive is applied between the layers of material in triangular areas A, B, C, and D leaving tabs 11–13 free. Alternative fastening means, such as sewing or rivets may be used to secure the triangular areas to the underlying material.

Figure 3:
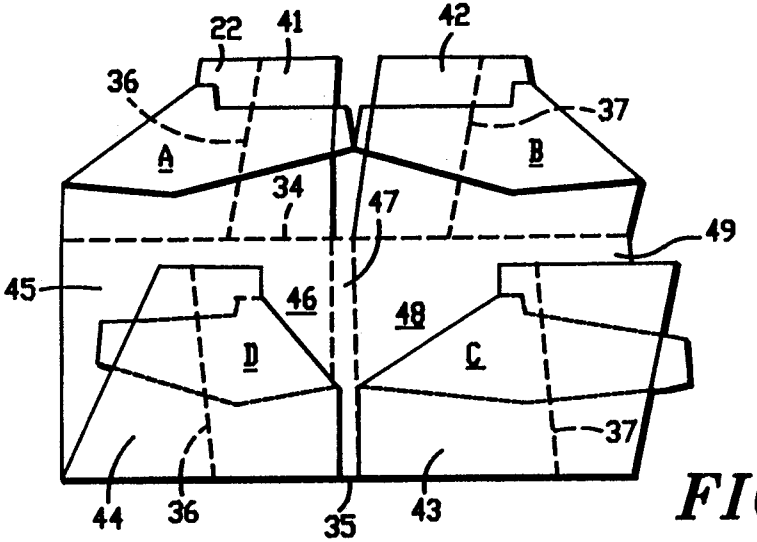
FIG. 3 is a plan view of the wallet of FIG. 2 showing the position of the upwardly folded sections and the gather lines during assembly of the wallet.

FIG. 3 shows the next folding step in the assembly of the wallet. Sections 41 through 44 are folded upwardly along pre-creased lines 34 and 35 leaving the center panels 45, 46, 47, 48 and 49 flat. Oppositely facing sections 41 and 44 are then pinched in the middle along the convex pre-creased lines 36A and 37C, respectively, thereby forming two opposed convex gathers that are perpendicular to the inward folds along lines 34 and 35.

Figure 4:
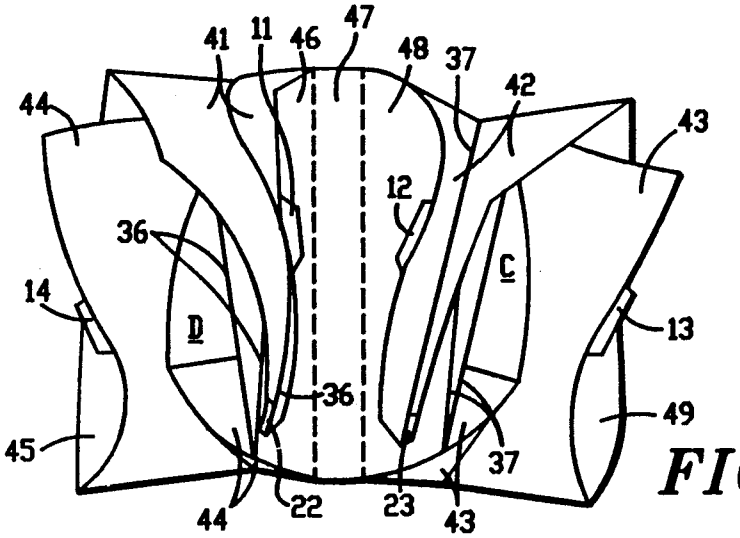
FIG. 4 is a top, perspective view showing the gathers being interlaid to form the pockets of the wallet.

Referring now to FIG. 4, the opposed gathers are next interlaid to form the pockets of the wallet as follows: triangular portion A of section 41 is placed between triangular portion D of section 44 and panel 46, and triangular portion D is tucked within section 41 between portion A and panel 45. Two interlaid gathers form one half of the foldable wallet having five pockets and two currency compartments. To complete the wallet, this process is next repeated for the remaining two opposed sections 42 and 43 as follows: sections 42 and 43 are pinched in the middle along convex pre-creased lines 37A and 37C, respectively, to form opposed convex gathers that are inserted within each other so that triangular portion B is inserted between triangular portion C and panel 48, and triangular portion C is inserted between portion B and panel 49. The concave pre-fold lines 36B and 37B form the bottom of the pockets.

The two halves of the completed wallet are connected by the central panel 47. The length of panel 47 defines the length of the long edge of both wallet halves. The width of panel 47 is defined by lines 38 and 39 and is sufficient to accommodate the thickness of the folded, closed wallet and its contents.

Figure 6:
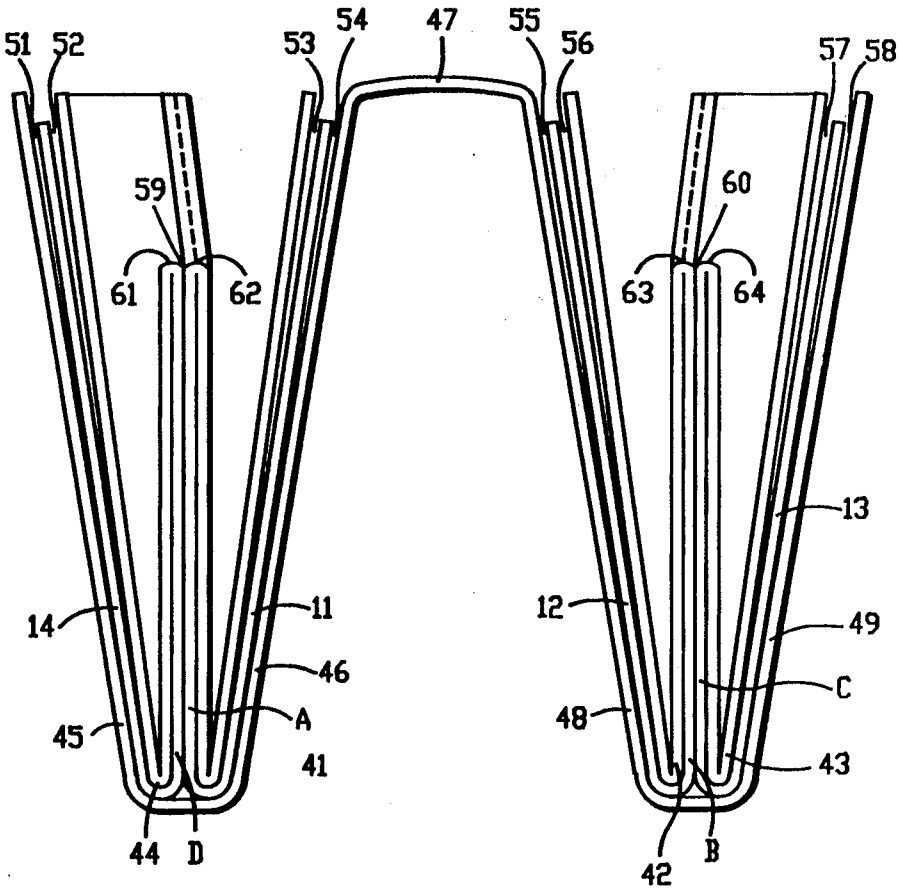
FIG. 6 is a sectional vie of the open wallet taken along the line 6—6 in FIG. 5.

Referring now to FIG. 6, the completed wallet includes ten pockets. Pockets 51 and 52 are formed by tab 14 which serves as a vertical pocket divider between panels 44 and 45. Tab 14 originates in the bottom of pockets 51 and 52 as a continuation of portion D. Pockets 53 and 54 are formed by vertical pocket divider, tab 11, which originates in the bottom of pockets 53 and 54 as a continuation of portion A. Pockets 55 and 56 are formed by vertical pocket divider, tab 12, which originates in the bottom of pockets 55 and 56 as a continuation of portion B. Pockets 57 and 58 are formed by vertical pocket divider, tab 13, which originates in the bottom of pockets 57 and 58 as a continuation of portion C. Pockets 51 through 58 define eight, full-sized and generally rectangular pockets with each pocket opening on one long edge of the pocket.

Figure 5:
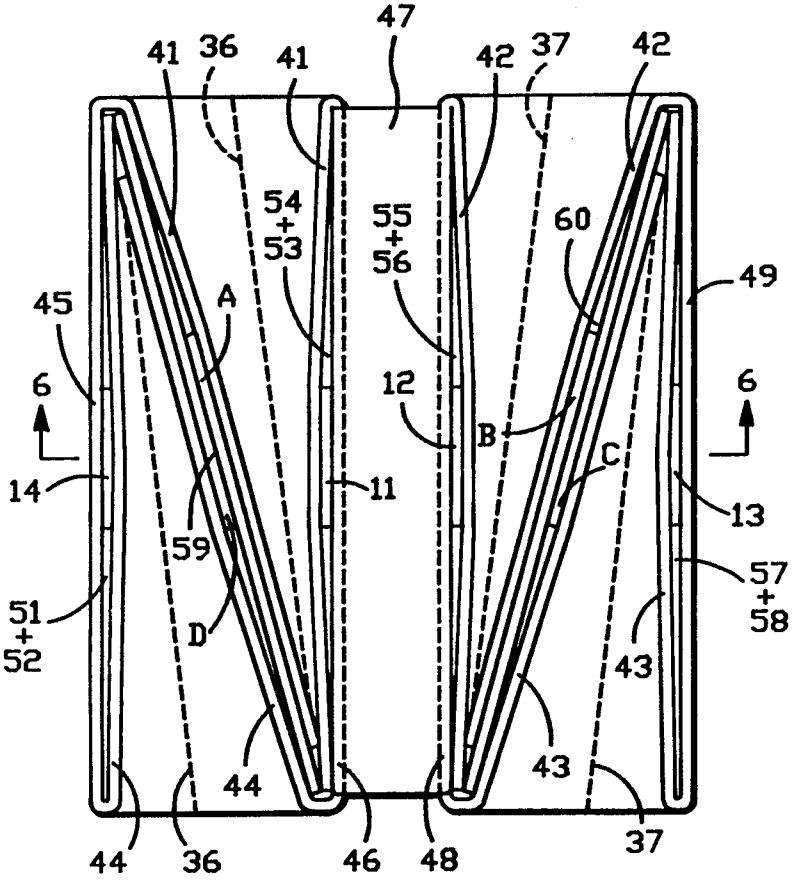
FIG. 5 is a top plan view of the wallet of FIG. 4 showing the exposed edges of the open wallet.

Referring now to FIG. 3 for clarity and to FIGS. 5 and 6 showing the completed wallet, the diagonal glued folds of portions A through D form four currency dividers 61–64. As previously discussed, the triangular portions A,B,C and D are created by the diagonal fold lines formed in panels 41–44. Currency may be folded in half around the index finger and placed around a diagonal line of a currency divider. The four currency dividers enable the user to separate currency by denomination. The currency is readily visible and available for vertical removal when the wallet is unfolded for use. Additional currency is vertically added to the wallet by placing it within the fold of the currency already in place around a currency divider.

The remaining two pockets, 59 and 60 respectively, are formed between the contiguous currency dividers 61 and 62 and the contiguous currency dividers 63 and 64, respectively. Pockets 59 and 60 lie between currency that is folded in opposite directions around the currency dividers 61–64. Pockets 59 and 60 may be used without disturbing the currency in place around the currency dividers 61–64. The completed wallet has 10 pockets for documents and 4 pockets for currency.

FIGS. 5 and 6 demonstrate that all pockets are accessible from the same plane when the wallet is opened and in use.

It will be recognized by those skilled in the art that the folds necessary to form the completed wallet require that the angles at the intersection of line 34 and 36, 34 and 37, 35 and 36, and 35 and 37 will be more or less than 90 degrees in order to facilitate the folding process. The plus or minus difference from 90 degrees enables the folds 36*a* and 36*c* to angle slightly upwardly over fold 36*b*, and the folds 37*a* and 37*c* to angle slightly upwardly over fold 37*b*.

Figure 8:
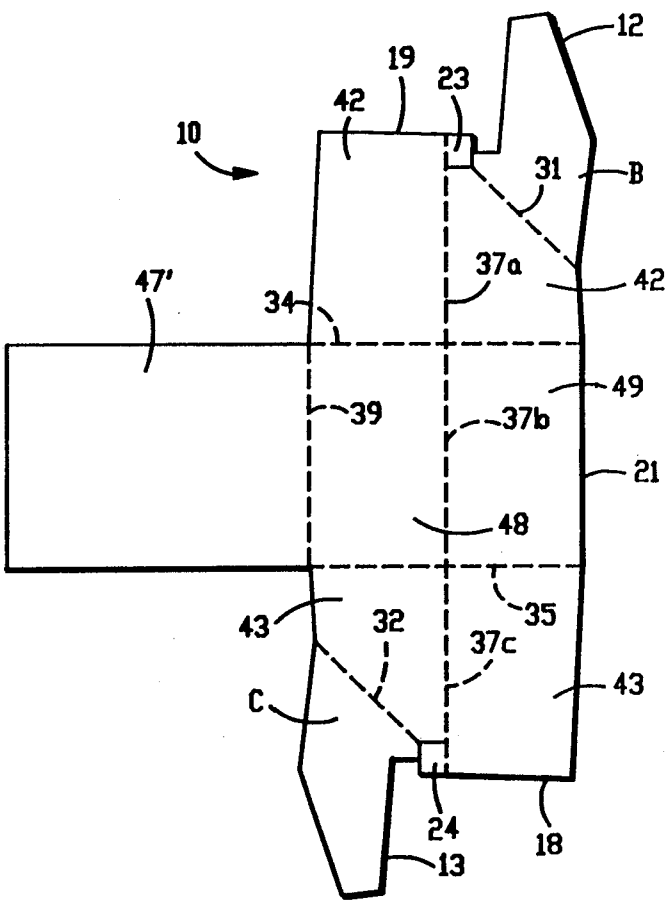
FIG. 8 is a top, plan view of another aspect of the present invention showing an extension of the middle strip of the material to form a closing flap for the non-foldable wallet.

Another aspect of the wallet of the present invention is shown in FIG. 8. The formation process described above is used to form one side of the FIG. 1 wallet. The panel 47' is elongated and tapered to form a closing flap that wraps around the completed wallet and covers the five pocket openings. The flap may be secured in place using velcro or other suitable fasteners.

The wallet of the present invention is inexpensively manufactured. The material of the exposed edges of the pockets may be extended, if desired, in order to provide sufficient material to form a double thickness of material or a finished, stitched or adhesively secured hem. Additionally, a closing device may be added to the folding wallet aspect in order to secure the two halves of the closed wallet together.

To those skilled in the art to which the present invention pertains, many widely varying embodiments and implementations of the principles of the present invention will be suggested from the foregoing. For instance, the dimensions of the wallet may be varied to enable a check book to be inserted into a pocket. A flap(s) formed from extension of the material may be provided and folded over and tucked back within the wallet to form a secure pocket for coins. The description and the disclosures presented herein are by way of illustration only and should not be considered to limit the present invention, the scope of which is more particularly set forth in the following claims.

I claim:

1. A wallet constructed from a single piece of flexible material by cutting, folding and interlaying formed gathers to form a plurality of storage compartments accessible from a single plane, the wallet comprising:

two generally rectangular pockets accessible from a long pocket edge;

a tab means for dividing each of the two rectangular pockets to form two storage compartments in each rectangular pocket;

two paper currency storage compartments each defining a section of the material folded to form a generally diagonal edge, the currency folding around the diagonal edges for storage; and one storage compartment between the material sections with the diagonal edges.

2. The wallet of claim 1 further comprising a closing means for securing the storage compartments of the wallet.

3. The wallet of claim 2 wherein the closing means is a section of the material which folds over the single access plane.

4. The wallet of claim 2 further comprising fastening means for detachably securing the closing means to the wallet.

5. The wallet of claim 1 further comprising at least one segment of material extending from the single piece of flexible material for forming a coin compartment.

6. The wallet of claim 1 further comprising a lining means for attachment to the single piece of flexible material.

7. A foldable wallet constructed from a single piece of flexible material by cutting folding, and interlaying formed gathers to form a plurality of storage compartments in each of two wallet sections accessible from a single plane when the wallet is unfolded, each wallet section comprising:

two generally rectangular pockets accessible from a long pocket edge;

a tab means for dividing each of the two rectangular pockets to form two storage compartments in each rectangular pocket;

two paper currency storage compartments each defining a section of the material folded to form a generally diagonal edge, the currency folding around the diagonal edges for storage; and one storage compartment between the material sections with the diagonal edges; and a connecting section of material between the two wallet sections for shielding all of the compartments in each section when the wallet is folded and for unfolding the wallet for access to all of the compartments in each wallet section.

8. The wallet of claim 7 further comprising a closing means for detachably fastening the two sections together when the wallet is folded.

9. The wallet of claim 7 further comprising at least one segment of material extending from the single piece of flexible material for forming a coin compartment in at least one of the two sections.

10. The wallet of claim 7 further comprising a lining means for attachment to the single piece of flexible material.

* * * * *